US007009475B2

(12) United States Patent
Niimi et al.

(10) Patent No.: US 7,009,475 B2
(45) Date of Patent: Mar. 7, 2006

(54) STARTER SOLENOID SWITCH WITH HIGHLY RELIABLE CONTACTS

(75) Inventors: Masami Niimi, Handa (JP); Tsutomu Shiga, Nukata-gun (JP); Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/058,227

(22) Filed: Feb. 16, 2005

(65) Prior Publication Data

US 2005/0184838 A1 Aug. 25, 2005

(30) Foreign Application Priority Data

Feb. 20, 2004 (JP) ..... 2004-044984

(51) Int. Cl.
*H01H 67/02* (2006.01)

(52) U.S. Cl. ..... 335/126; 335/131

(58) Field of Classification Search ..... 335/126
See application file for complete search history.

(56) References Cited

U.S. PATENT DOCUMENTS 4,801,909 A * 1/1989 Fasola ..... 335/126
5,521,566 A * 5/1996 Krubsack et al. ..... 335/126
5,525,947 A * 6/1996 Shiga et al. ..... 335/126
5,656,981 A * 8/1997 Niimi et al. ..... 335/126
6,822,544 B1 * 11/2004 Shiga et al. ..... 335/126
2002/0053961 A1 * 5/2002 Kajino ..... 335/126
2003/0193382 A1 * 10/2003 Shiga et al. ..... 335/126

FOREIGN PATENT DOCUMENTS

JP A 2003-293913 10/2003

* cited by examiner

*Primary Examiner*—Lincoln Donovan
(74) *Attorney, Agent, or Firm*—Oliff & Berridge, PLC

(57) ABSTRACT

A starter solenoid switch according to the present invention includes a first and a second set of contacts that are disposed between a battery and a starter motor in parallel with each other. The first and the second sets of contacts are so configured that the second set of contacts is closed to supply a lighter electric current to the starter motor before the first set of contacts is closed to supply a heavier electric current to the same. The second set of contacts is composed of a second fixed contact and a second movable contact, one of which includes a low-resistance portion at one end thereof and a high-resistance portion that contains more carbon than the low-resistance portion. The low-resistance and the high-resistance portions are serially disposed along a conducting path of electric current from the battery to the starter motor, thereby ensuring reliability of the starter solenoid switch.

21 Claims, 4 Drawing Sheets

STARTER SOLENOID SWITCH WITH HIGHLY RELIABLE CONTACTS

CROSS-REFERENCE TO RELATED APPLICATION

This application claims priority from Japanese Patent Application No. 2004-44984, filed on Feb. 20, 2004, the content of which is hereby incorporated by reference into this application.

BACKGROUND OF THE INVENTION

1. Technical Field of the Invention

The present invention relates generally to a starter solenoid switch for supplying electric power from a battery to a starter motor in two stages. More particularly, the invention relates to an improved structure of a set of contacts of the starter solenoid switch, which makes and breaks an electrical connection between the battery and the starter motor.

2. Description of the Related Art

In recent years, the number of automobiles, which are equipped with an idle stop system, has increased to meet a demand of improving fuel economy and reducing exhaust gases.

An idle stop system is generally employed to automatically stop the engine when the automobile is stopped for, by way of example, waiting for a traffic light to change or traffic congestion. Therefore, the starter of an automobile with an idle stop system is more frequently operated in comparison with that of an automobile without an idle stop system.

When the starter of an automobile equipped with an idle stop system is designed to crank the engine by bringing a pinion gear thereof into mesh with a ring gear of the engine, the pinion gear and the ring gear may be easily worn down due to the frequent operation of the starter. As a result, the pinion gear of the starter cannot be smoothly brought in mesh with the ring gear of the engine, thus resulting in a difficulty in cranking the engine.

To overcome such a difficulty, Japanese Unexamined Patent Publication No. 2003-293913, an English equivalent of which is U.S. Pat. No. 6,822,544 B2, discloses a magnet switch for a starter.

According to the disclosure, the magnet switch for the starter includes a main contact portion and an auxiliary contact portion, both of which have a fixed and a movable contact and are disposed between a battery and a starter motor in parallel with each other. The main and auxiliary contact portions are so configured that the auxiliary contact portion is closed prior to the main contact portion, thereby supplying electric current from the battery to the starter motor in two stages. Moreover, the fixed contact of the auxiliary contact portion is made of a carbon material that has a high electric resistivity, so that only limited electric current is supplied to the starter motor when only the auxiliary contact portion is closed in the first stage. As a result, in the first stage, the starter motor rotates slowly while a pinion gear of the starter is brought into mesh with a ring gear of the engine, thereby suppressing wear of both the pinion gear and the ring gear. After the pinion gear is completely brought into mesh with the ring gear, the main contact portion is then closed to rotate the starter motor at full speed, thereby reliably cranking the engine.

In such a magnet switch, when assuming that the battery has a nominal voltage of 12 V, the fixed contact of the auxiliary contact portion, which is made of a carbon material, is required to have a resistance in a range of 20 to 100 mΩ. Further, in order to be capable of being arranged inside the magnet switch, the fixed contact of the auxiliary contact portion is required to have a cross sectional area perpendicular to the conducting path of electric current in a range of 50 to 100 $mm^2$ and a length along the conducting path of electric current in a range of 5 to 10 mm.

To meet such requirements, it is necessary for the carbon material of the fixed contact of the auxiliary contact portion to have an electric resistivity in a range of 1,000 to 15,000 $\mu\Omega$cm, and accordingly to contain as more carbon as possible (e.g., 100 wt %).

Further, the fixed contact of the auxiliary contacting portion has two opposite ends disposed along the conducting path of electric current. One end is electrically and mechanically connected, by press fitting, to a metal holder that is connected to the battery; the other end is formed as a contact surface on which the movable contact of the auxiliary contact portion strikes the fixed contact.

However, since carbon has a high electric resistivity, when electric current passes through the auxiliary contact portion, heat may be considerably generated by the fixed contact of the auxiliary contact portion that is made of the carbon material, thereby causing thermal expansion and shrinkage of the metal holder that is connected with the fixed contact. As a result, cracks may be generated in the contacting area between the metal holder and the fixed contact of the auxiliary contact portion due to the difference in coefficient of thermal expansion therebetween, thereby causing a failure of the electrical connection between the battery and the starter motor.

As an alternative, one may consider to embed a copper twisted wire that is connected to the battery in the fixed contact of the auxiliary contact portion, as in the case of making electrical connection for a motor brush. However, the difference in coefficient of thermal expansion between the fixed contact of the auxiliary contact portion that is made of the carbon material and the copper twisted wire would still cause cracks in the contacting area therebetween, thereby causing a failure of the electrical connection.

On the other hand, when the auxiliary contact portion is closed, the movable contact makes contact with the fixed contact at a plurality of contact points on the contact surface. As a result, a high level of heat may be generated at those contact points due to the high electric resistively of the fixed contact made of the carbon material, thereby causing carbon particles to be separated from the contact surface at those points.

SUMMARY OF THE INVENTION

The present invention has been made in view of the above-mentioned problem; it is, therefore, a primary object of the present invention to provide a starter solenoid switch with an auxiliary contact portion that is made of carbon materials and has an improved structure ensuring high reliability of the auxiliary contact portion.

According to one aspect of the present invention, a starter solenoid switch includes:

a first set of contacts (corresponding to the above-described main contact portion) including a first fixed contact and a first movable contact, the first set of contacts being disposed between a battery and a starter motor to make and break an electrical connection therebetween; and a second set of contacts (corresponding to the above-described auxiliary contact portion) including a second fixed contact and a second movable contact, the second set of contacts being disposed electrically parallel to the first set of contacts between the battery and the starter motor, the first and the second sets of contacts being so configured that the second movable contact makes contact with the second fixed contact to supply a lighter electric current to the starter motor before the first movable contact makes contact with the first fixed contact to supply a heavier electric current to the starter motor, wherein one of the second fixed contact and the second movable contact includes a low-resistance portion at one end thereof and a high-resistance portion that contains more carbon than the low-resistance portion, and wherein the low-resistance and the high-resistance portions are serially disposed along a conducting path of electric current from the battery to the starter motor.

In the above starter solenoid switch according to the invention, when the low-resistance portion is connected to an electrically conducting member that is connected to either the battery or the starter motor, the contact resistance between the low-resistance portion and the electrically conducting member can be made small, thereby suppressing heat generated in the contacting area therebetween. Further, the difference in coefficient of thermal expansion between the low-resistance portion and the electrically conducting member can also be made small, thereby ensuring reliability of the contact that includes the low-resistance portion.

Otherwise, when the low-resistance portion is to make contact with the other contact that faces the low-resistance portion, heat generated at contacting points on the contact surface of the low-resistance portion will be suppressed, thus preventing separation of carbon particles from the contact surface. As a result, the durability of the contact that includes the low-resistance portion is secured.

Further, it is preferable that the low-resistance portion has an electric resistivity of 100 $\mu\Omega$cm or less, and the high-resistance portion has an electric resistivity of 100 times or more higher than that of the low-resistance portion. As a result, a high electric resistance of the second set of contacts can be secured, thereby reliably providing the lighter electric current to the starter motor when only the second set of contacts is closed.

The starter solenoid switch may further include an electrically conductive member that is electrically and mechanically connected to the low-resistance portion. As a result, as described above, the contact resistance between the low-resistance portion and the electrically conducting member can be made small, thereby suppressing heat generated in the contacting area therebetween.

The electrically conductive member may be a twisted wire made of a metal material, for example Cu. Since the metal-made twisted wire has flexibility, the use thereof provides a flexibility in arranging the second set of contacts in the starter solenoid switch.

The electrically conductive member may also be a metal plate. Since the metal plate has high rigidity, it is possible to accurately keep the positional relationship between the low-resistance portion and the metal plate in the starter solenoid switch.

Moreover, it is preferable that the contact, which includes the low-resistance and the high-resistance portions, further includes an intermediate portion that is interposed between the low-resistance portion and the high-resistance portion and has a coefficient of thermal expansion between those of the low-resistance and the high-resistance portions.

As a result, the differences in coefficient of thermal expansion between the low-resistance portion and the intermediate portion and between the high-resistance portion and the intermediate portion can be made small. Accordingly, it is possible to prevent cracks, which otherwise may occur at interfaces between different portions during formation of the contact or when the contact experiences repeated excessive increase of temperature, thereby improving reliability of the contact.

Furthermore, it is preferable that the second fixed contact includes the low-resistance and the high-resistance portions. As a result, it is possible to prevent the second fixed contact, which is made of carbon materials, from vibrations or shocks that may occur when the second movable contact makes contact with the second fixed contact.

The second fixed contact is preferably so arranged that the low-resistance portion is to be connected to an external terminal, which is connected to the battery, in a manner allowing heat transfer from the second fixed contact to the external terminal. As a result, heat generated by the second fixed contact can be effectively removed therefrom, thereby preventing an excessive increase in the temperature of the second fixed contact.

It is further preferable that the low-resistance portion is to be connected to the external terminal via the electrically conductive member, thereby making the second fixed contact, the electrically conductive member and the external terminal together more compact.

It is yet further preferable that the second fixed contact, the electrically conductive member, and the external terminal are integrally formed by molding. As a result, the manufacturing of the starter solenoid switch as a whole is facilitated, thus saving the manufacturing cost.

According to another aspect of the present invention, in a solenoid magnet switch as described above, one of the second fixed contact and the second movable contact includes a first low-resistance portion at a first end thereof, a second low-resistance portion at a second end thereof that is opposite to the first end, and a high-resistance portion between the first and the second low-resistance portions which contains more carbon than both the first and the second low-resistance portions, and wherein the first low-resistance portion, the high-resistance portion, and the second low-resistance portion are serially disposed along a conducting path of electric current from the battery to the starter motor.

With the above arrangement, heat generated at both ends of the contact that includes the two low-resistance portions, one of which may be connected to an electrically conductive member and the other is to make contact with the other contact, can be suppressed, thereby ensuring reliability of the contact including the two low-resistance portions.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
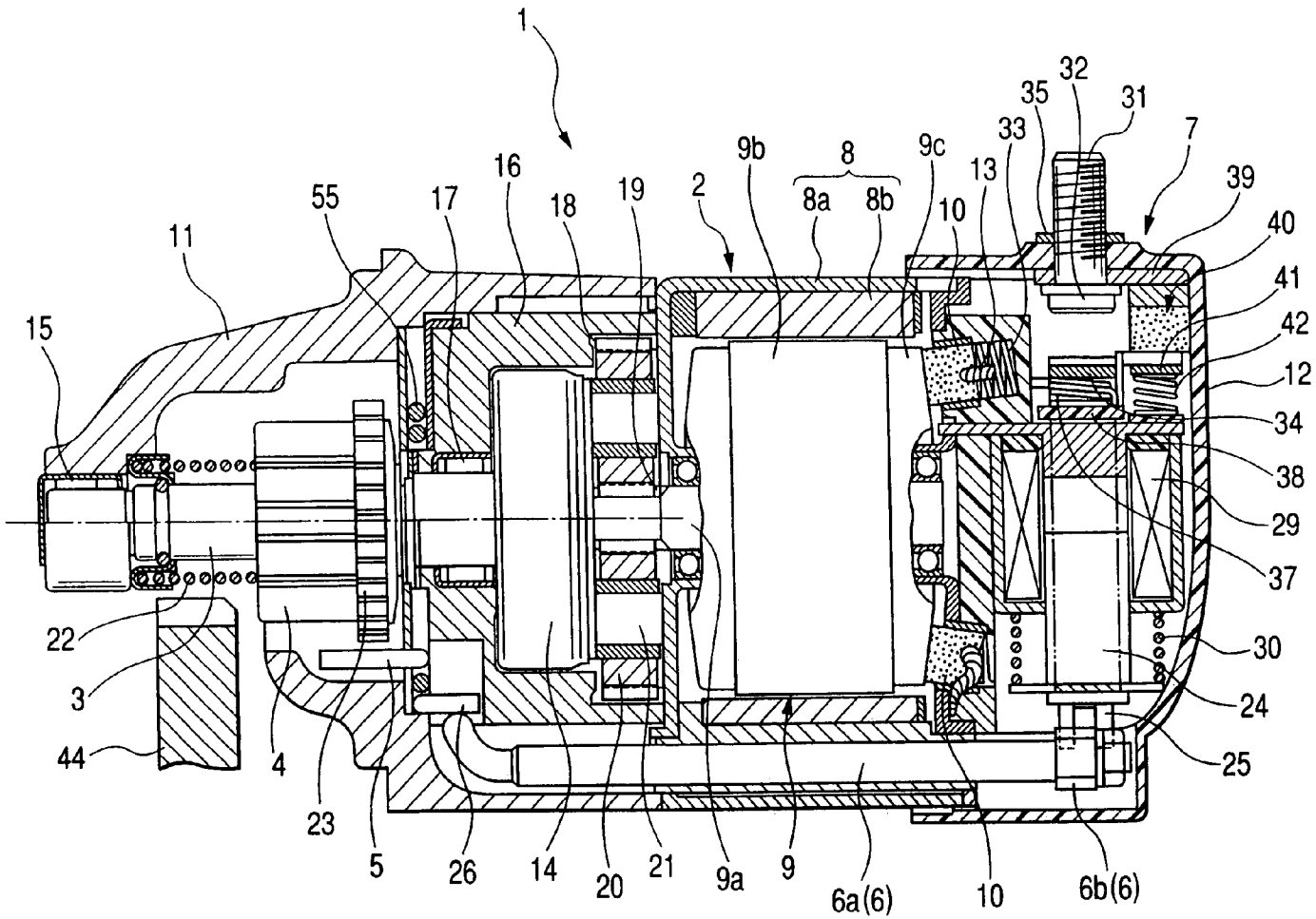
FIG. 1 is a partially cross-sectional side view showing an overall structure of a starter in connection with the first embodiment of the invention.

The preferred embodiments of the present invention will be described hereinafter with reference to FIGS. 1–8.

It should be noted that, for the sake of clarity and understanding, identical components having identical functions in different embodiments of the invention have been marked, where possible, with the same reference numerals in each of the figures.

[First Embodiment]

FIG. 1 shows an overall structure of a starter 1 that includes a starter solenoid switch 7 according to the first embodiment of the invention.

As shown in FIG. 1, the starter 1 includes a starter motor 2, an output shaft 3 driven by the starter motor 2, a pinion gear 4 mounted on the output shaft 3, a rotation restriction member 5 that restricts rotation of the pinion gear 4 before start up of the starter motor 2, and the solenoid switch 7 that makes and breaks an electrical connection for supplying electric power to the starter motor 2 and drives the rotation restriction member 5 via a connecting member 6.

The starter motor 2 is a DC motor including a magnetic field system 8 that creates a magnetic flux, an armature 9 with a commutator, and brush 10 that is in slidable contact with the commutator.

The magnetic field system 8 includes a yoke 8*a* for forming a magnetic circuit and a plurality of permanent magnets 8*b* disposed on inner periphery of the yoke 8*b*. The yoke 8*a*, which also serves as the frame of the starter motor 2, is disposed between a front housing 11 and an end cover 12 and fixed thereto using through-bolts (not shown). Additionally, it should be noted that filed windings may also be used instead of the permanent magnets 8*b* for creating the magnetic flux.

The armature 9 includes an armature shaft 9*a*, an armature core 9*b* secured on the armature shaft 9*b*, and an armature winding 9*c* wound around the armature core 9*b*.

The armature winding 9*c* has coil ends (at the right side thereof in FIG. 1) that serve as the commutator; the end surfaces of those coil ends accordingly function as a commutator surface.

The brush 10 is disposed in slidable contact with the commutator surface and urged to the commutator surface by a brush spring 13.

The output shaft 3 is coaxially connected, via a speed reducer to be described below and a clutch 14, to the armature shaft 9*a*. One end of the output shaft 3 is rotatably supported by the front housing 11 via a bearing 15; the other end is rotatably supported by a gear case 16 that is secured in the front housing 11 via a bearing 17.

The gear case 16 has a cylindrical wall portion that surrounds the speed reducer and the clutch 14. On the inner surface of the cylindrical wall portion of the gear case 16, an internal gear 18 is formed which serves as a member of the speed reducer.

The seed reducer is composed of the internal gear 18, a sun gear 19 formed at an end (the left end in FIG. 1) of the armature shaft 9*a*, and a plurality of planet gears 20 that are in mesh with the internal gear 18 and the sun gear 19. The speed reducer reduces a rotational speed of the armature 9 to an orbital speed of the planet gears 20.

The clutch 14 receives a torque from the planet gears 20 via a gear shaft 21 that rotatably supports the planet gears 20 and transmits the torque to the output shaft 3 via rollers (not shown). The clutch 14 is such a one-way clutch that when the rotational speed of the output shaft 3 exceeds that of the clutch 14 (i.e., the orbital speed of the planet gears 20), those rollers run idle so as to prevent over run of the starter motor 2.

The pinion gear 4 transmits a torque from the starter motor 2 to a ringer gear 44 of an engine. The pinion gear 4 engages with the output shaft 3 through helical splines (not show) that are formed on an inner surface of the pinion gear 4 and an outer surface of the output shaft 3, so that the pinion gear 4 can rotate together with the output shaft 3 and move in an axial direction with respect to the output shaft 3. A pinion spring 22 urges the pinion gear 4 to get away from the ring gear 44.

A rotation restriction ring 23 is integrally formed or irrotatably fixed with the pinion gear 4. The rotation restriction ring 23 has an outer diameter slightly greater than that of the pinion gear 4 and an outer surface on which a plurality of recesses are formed at even intervals in the circumferential direction thereof.

An annular spring 55 is disposed adjacent to the pinion gear 4, which has two ends that are bent and extend parallel to the output shaft 3 toward opposite directions, thereby forming the rotation restriction member 5 and a protruding member 26 respectively.

As shown in FIG. 1, the rotation restriction member 5 extends leftwardly parallel to the output shaft 3, with a clearance between an upper surface thereof and the outer surface of the rotation restriction ring 23. The rotation restriction member 5 is retained such that it can move with respect to the rotation restriction ring 23 in the radial direction.

Specifically, when driven by the starter solenoid switch 7 via the connecting member 6 and the protruding member 26, the rotation restriction member 5 moves from the stationary position shown in FIG. 1 toward the rotation restriction ring 23 in the radial direction and engages one of the recesses on the outer surface of the rotation restriction ring 23, thereby restricting rotation of the pinion gear 4.

The connecting member 6 includes a rod portion 6*a* and an arm portion 6*b*. The rod portion 6*a* extends, as shown in FIG. 1, outside the armature 9 and parallel to the armature shaft 9*a*. One end of the rod portion 6*a* is bent at approximately right angle to engage with the protruding member 26 that is integrally formed with the rotation restriction member 5; the other end is connected to one end of the arm portion 6*b*. At the same time, the other end of the arm portion 6*b* is connected to a hook 25 that is fixed to a plunger 24 of the starter solenoid switch 7.

With such an arrangement, when an upward motion of the plunger 24 is transmitted to the arm portion 6*b* of the connecting member 6, the rod portion 6*a* of the same is turned with the bent end thereof urging the protruding member 26, thereby bring the rotation restriction member 5 into engagement with the rotation restriction ring 23 on the pinion gear 4.

The starter solenoid switch 7 includes a solenoid 29, the plunger 24, and a return spring 30. The solenoid 29 creates a magnetism when electric current is supplied, referring to FIG. 2, from a battery 28 to the solenoid 29 upon closing a starter switch 27. The plunger 24 is disposed inside the solenoid 29 and moves upwardly from the stationary position shown in FIG. 1 subject to the magnetism created by the solenoid 29. The return spring 30 returns the plunger 24 to the stationary position when the electric current supply from the battery 28 to the solenoid 29 is stopped.

Figure 2:
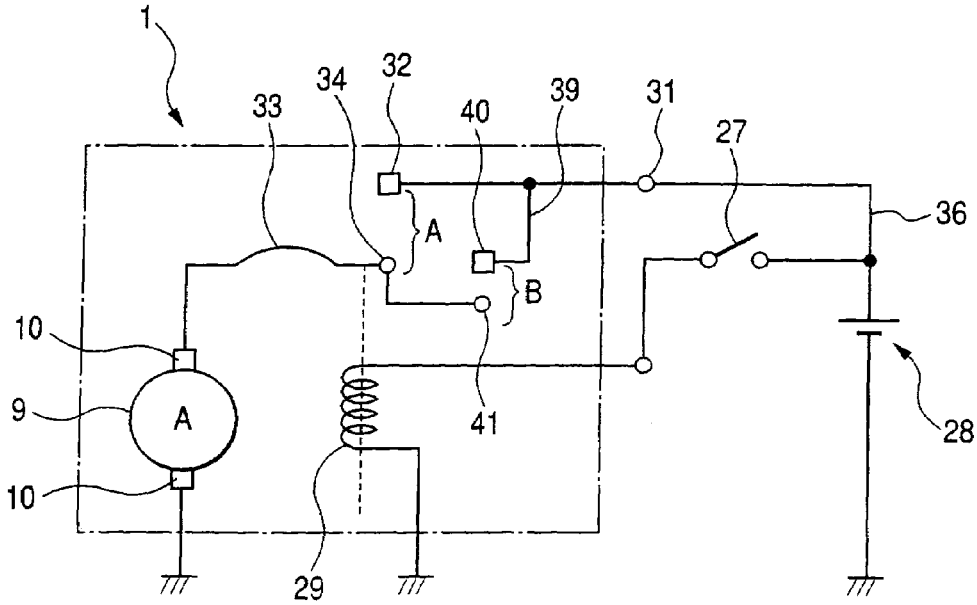
FIG. 2 is an electrical diagram of the starter of FIG. 1.

The starter solenoid switch 7 further includes, as shown in FIG. 2, a first set A of contacts and a second set B of contacts, which are disposed between the battery 28 and the starter motor 2 in parallel with each other.

The first set A of contacts is composed of a first fixed contact 32, which is connected to the battery 28 via an external terminal 31, and a first movable contact 34 that is connected to a positive brush 10 of the starter motor 2 via an electrically conductive brush lead 33.

Figure 3:
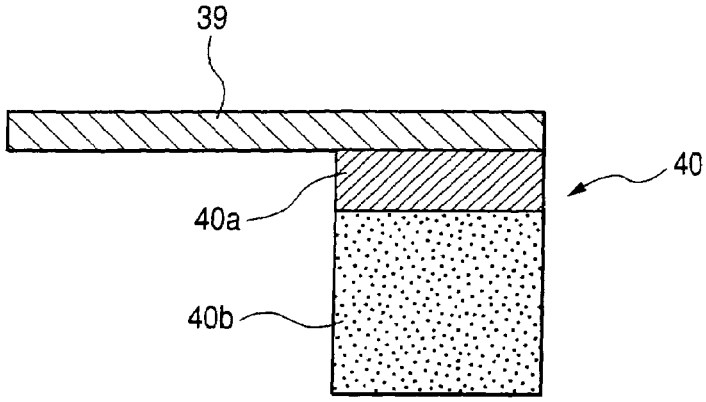
FIG. 3 is an enlarged cross-sectional view showing a second fixed contact of a starter solenoid switch according to the first embodiment of the invention.

The external terminal 31 is, as shown in FIG. 1, partially fit into the starter 1 through a side wall of the end cover 12 and fixed to the end wall with a washer 35. The external terminal 31 has a bolt portion outside the starter 1, to which an end of a battery cable 36 as shown in FIG. 3 is connected and fixed with a nut (not show).

The first fixed contact 32 is formed integrally with the external terminal 31 and disposed inside the end cover 12.

The first movable contact 34 is secured to an insulative contact holder 38, which is made, for example, of resin, subject to an urging force of a contact spring 37. The first movable contact 34 is movable, with an upward motion of the plunger 24, toward the first fixed contact 32.

The contact holder 38 is supported by a flange portion (not shown) that is secured to an end of the plunger 24, so that it can move together with the flange portion and the plunger 24.

The second set B of contacts is composed of a second fixed contact 40, which is electrically and mechanically connected to the external terminal 31 via a conductive metal plate 39, and a second movable contact 41 that is electrically connected to the first movable contact 34 via an electrically conductive lead (not shown) made, for example, of a copper twisted wire.

The conductive metal plate 39 is made of a highly conductive metal material such as Cu. Referring to FIG. 3, the conductive metal plate 39 is formed integrally with the second fixed contact 40; referring now to FIG. 1, it is electrically and mechanically connected, inside the end cover 12, to the external terminal 31.

The second fixed contact 40 is made of carbon materials. Specifically, as shown in FIG. 3, the second fixed contact 40 includes a low-resistance portion 40*a*, which has an electric resistivity of 100 $\mu\Omega$cm or less, and a high-resistance portion 40*b* that has an electric resistivity of 100 times or more higher than that of the low-resistance portion 40*b*. The low-resistance portion 40*a* is disposed at the end of the second fixed contact 40 to which the conductive metal plate 39 is connected; the high-resistance portion 40*b* is disposed at the other end of the same which faces (or abuts) the second movable contact 41.

The low-resistance portion 40*a* contains a certain amount of carbon and highly conductive metal materials, for example Cu, in an amount of approximately 70 wt %. The high-resistance portion 40*b* contains approximately 100 wt % carbon and has a length, along the conducting path of electric current from the battery 28 to the starter motor 2, approximately three times greater than that of the low-resistance portion 40*a*.

The second movable contact 41 is also secured to the contact holder 38, subject to an urging force of a contact spring 42. The second movable contact 41 is also movable, with an upward motion of the plunger 24, toward the second fixed contact 40.

The first and the second sets of contacts are so configured that, with an upward motion of the plunger 24, the second set B of contacts is to be closed prior to the first set A of contacts. Specifically, when the starter 1 is in the rest condition as shown in FIG. 1, the distance between the second fixed contact 40 and the second movable contact 41 is made less than that between the first fixed contact 32 and the first movable contact 34.

Next, operation of the starter 1 will be described with reference to FIGS. 1–2.

When the starter switch 27 is closed, electric current is supplied from the battery 28 to the solenoid 29 of the starter solenoid switch 7. This causes the solenoid 29 to create the magnetism, thereby attracting the plunger 24 to move in the upward direction of FIG. 1 against the return spring 30. The upward motion of the plunger 24 is then transmitted, via the connecting member 6, to the protruding member 26, so that the protruding member 26 and the rotation restriction member 5 move together in the upward direction. As a result, the rotation restriction member 5 is brought into engagement with one of the recesses on the outer surface of the rotation restriction ring 23, thereby restricting rotation of the pinion gear 4.

In the meanwhile, with the upward motion of the plunger 24, the second set B of contacts is closed prior to the first set A of contacts. Since the second fixed contact 40 has a high electric resistance, a relatively light electric current, for example in a range of 100 to 300 A, is supplied from the battery 28 to the armature 9, thereby turning the armature 9 slowly. The rotational motion of the armature 9 is then transmitted, via the speed reducer and the clutch 14, to the output shaft 3.

When the output shaft 3 rotates, the pinion gear 4 is also urged to rotate together with the output shaft 3. However, since rotation of the pinion gear 4 is restricted by the rotation restriction member 5 as described above, the pinion gear 4 cannot rotate and, instead, moves in the leftward direction of FIG. 1 against the pinion spring 22 through engagement of the helical splines, until the pinion gear 4 is smoothly brought into complete mesh with the ring gear 44.

With the meshing of the pinion gear 4 and the ring gear 44, the rotation restriction member 5 gets out from the recess on the outer surface of the rotation restriction ring 23, thereby releasing the pinion gear 4 from the rotation restriction. Then, the rotation restriction member 5 is further moved upwardly to the rear (i.e., the left side in FIG. 1) of the rotation restriction ring 23, thereby restricting rightward axial movement of the pinion gear 4.

In addition, when the pinion gear 4 cannot be smoothly brought into mesh with the ring gear 44 thus the left end surface of the pinion gear 4 collides with the right end surface of the ring gear 44, the pinion gear 4 stops the axial movement once and rotates together with the output shaft 3. Since the rotation restriction member 5 is formed with the spring 55, in other words it has resilience, the pinion gear 4 is allowed to rotate in a certain extent with the rotation restriction member 5 that is still in engagement with the rotation restriction ring 23. When the pinion gear 4 has rotated to an angular position at which it can mesh with the ring gear 44, the pinion gear 4 stops the rotational movement and again moves in the leftward direction of FIG. 1 until completely meshing with the ring gear 44.

After the rotation restriction member 5 gets out from the recess on the outer surface of the rotation restriction ring 23 upon complete meshing of the pinion gear 4 with the ring gear 44, the plunger 24 is further moved in the upward direction, thereby closing the first set A of contacts of the starter solenoid switch 7. As a result, a heavy (e.g., 700 A) electric current is supplied from the battery 28 to the armature 9, thereby turning the armature 9 at full speed.

Consequently, the pinion gear 4 is also turned at full speed together with the ring gear 44, thereby cranking the engine.

Once the engine starts and the starter switch 27 is closed, the electric current supply from the battery 28 to the solenoid 9 is stopped, and accordingly, the magnetism created by the solenoid 9 disappears. The plunger 24 is then returned by the return spring 30 in the downward direction of FIG. 1, thereby opening the first and the second sets of contacts in turn. As a result, the electric power supply from the battery 28 to the armature 9 is stopped, thus bringing the armature 9 to a halt.

With returning motion of the plunger 24, the rod portion 6*a* of the connecting member 6 is turned back to its initial position, thereby releasing the protruding member 26 from being urged. Then, the rotation restriction member 5 is also returned, by a return spring (not shown), from the rear of the rotation restriction ring 23 to its initial position as shown in FIG. 1.

As a result, the restriction on axial movement of the pinion gear 4 by the rotation restriction member 5 is released, so that the pinion gear 4 is returned to the stationary position as shown in FIG. 1 by the pinion spring 22 and the ring gear 44.

As described previously, in this embodiment, the second fixed contact 40 of the second set B of contacts has the low-resistance portion 40*a* at the end to which the conductive metal plate 39 is connected. Since the low-resistance portion 40*a* has such a low electric resistivity of 100 $\mu\Omega$cm or less, the contact resistance between the low-resistance portion 40*a* and the conductive metal plate 39 is low. As a consequence, it becomes possible to suppress heat generated in the contacting area between the low-resistance portion 40*a* and the conductive metal plate 39.

Further, the difference in coefficient of thermal expansion between the low-resistance portion 40*a* and the conductive metal plate 39 is made small, so that cracks, which otherwise may occur in the contacting area therebetween, are prevented, thereby ensuring high reliability of the second set B of contacts.

Moreover, since the low-resistance portion 40*a* contains metal materials in an amount of approximately 70 wt %, it has a high mechanical strength, thereby enabling the connection between the low-resistance portion 40*a* and the conductive metal plate 39 to withstand vibrations or shocks.

Furthermore, since the second fixed contact 40 of the second set B of contacts is made of carbon materials, it becomes possible to suppress vibrations or shocks, which otherwise may occur when the second movable contact 41 makes contact with the second fixed contact 40, thereby ensuring stable electric power supply to the starter motor 2.

[Second Embodiment]

Figure 4:
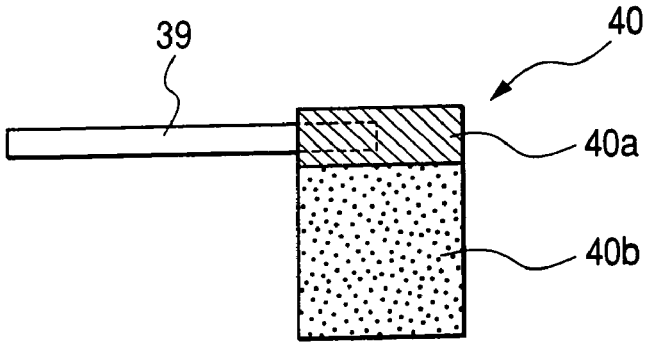
FIG. 4 is an enlarged cross-sectional view showing a second fixed contact of a starter solenoid switch according to the second embodiment of the invention.

FIG. 4 shows a second fixed contact 40 of a starter solenoid switch according to the second embodiment of the present invention.

The starter solenoid switch of the present embodiment is almost identical to that of the previous embodiment.

However, in this embodiment, the conductive metal plate 39 is partially embedded in the low-resistance portion 40*a* of the second fixed contact 40 and integrally formed with the low-resistance portion 40*a*; in the previous embodiment, it is connected to the low-resistance portion 40 abutting the end of the low-resistance portion 40.

[Third Embodiment]

Figure 5:
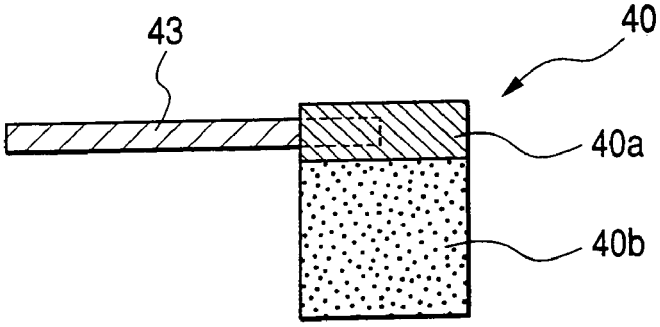
FIG. 5 is an enlarged cross-sectional view showing a second fixed contact of a starter solenoid switch according to the third embodiment of the invention.

FIG. 5 shows a second fixed contact 40 of a starter solenoid switch according to the third embodiment of the present invention.

The starter solenoid switch of the present embodiment is almost identical to those of the previous embodiments.

However, in this embodiment, an electrically conductive lead 43 is used, instead of the conductive metal plate 39 in the previous embodiments, to electrically connect the second fixed contact 40 with the external terminal 31 described previously. The electrically conductive lead 43 is partially embedded in the low-resistance portion 40*a* of the second fixed contact 40 and integrally formed with the low-resistance portion 40*a*.

The electrically conductive lead 43 is made, for example, of copper twisted wire 43. Since the electrically conductive lead 43 has flexibility, the use thereof provides a flexibility in arranging the second fixed contact 40 in the starter solenoid switch.

[Fourth Embodiment]

Figure 6:
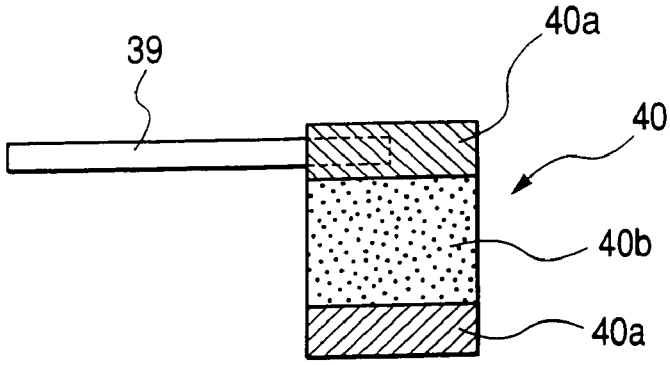
FIG. 6 is an enlarged cross-sectional view showing a second fixed contact of a starter solenoid switch according to the fourth embodiment of the invention.

FIG. 6 shows a second fixed contact 40 of a starter solenoid switch according to the fourth embodiment of the present invention.

The starter solenoid switch of the present embodiment is almost identical to those of the previous embodiments.

However, in this embodiment, the second fixed contact 40 further includes another low-resistance portion 40*a*, which has also an electric resistivity of 100 $\mu\Omega$cm or less, at the other end thereof that faces (or abuts) the second movable contact 41.

With the above arrangement, when the second set B of contacts is closed, heat generated at contact points on the end of the second fixed contact 40, which abuts the second movable contact 41, is also suppressed, thereby improving durability of the second fixed contact 40.

[Fifth Embodiment]

Figure 7:
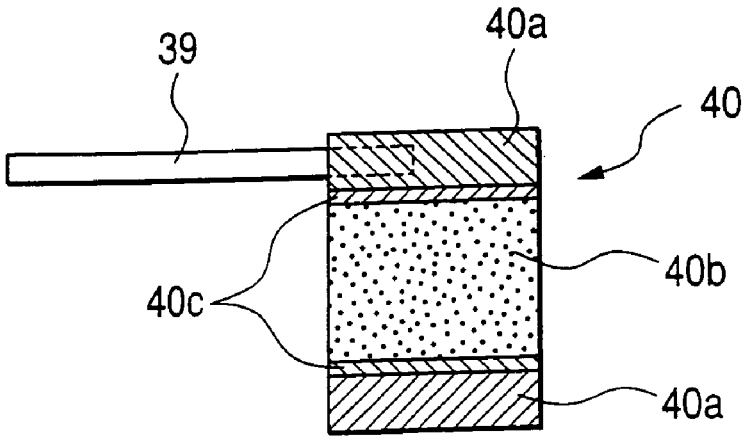
FIG. 7 is an enlarged cross-sectional view showing a second fixed contact of a starter solenoid switch according to the fifth embodiment of the invention.

FIG. 7 shows a second fixed contact 40 of a starter solenoid switch according to the fifth embodiment of the present invention.

The starter solenoid switch of the present embodiment is almost identical to that of the previous embodiment.

However, in this embodiment, the second fixed contact 40 further includes two intermediate portions 40*c*, each of which is disposed between a low-resistance portion 40*a* and the high-resistance portion 40*b*.

Both the intermediate portions 40*c* contain a certain amount of carbon and have a coefficient of thermal expansion between those of the low-resistance portions 40*a* and the high-resistance portion 40*b*.

Accordingly, the differences in coefficient of thermal expansion between the low-resistance portions 40*a* and the intermediate portions 40*c* and between the high-resistance portion 40*b* and the intermediate portions 40*c* are made small. Therefore, it becomes possible to prevent cracks, which otherwise may occur at interfaces between different portions during formation of the second fixed contact 40 or when the second fixed contact 40 experiences repeated excessive increase of temperature, thereby improving reliability of the second fixed contact 40.

[Sixth Embodiment]

Figure 8:
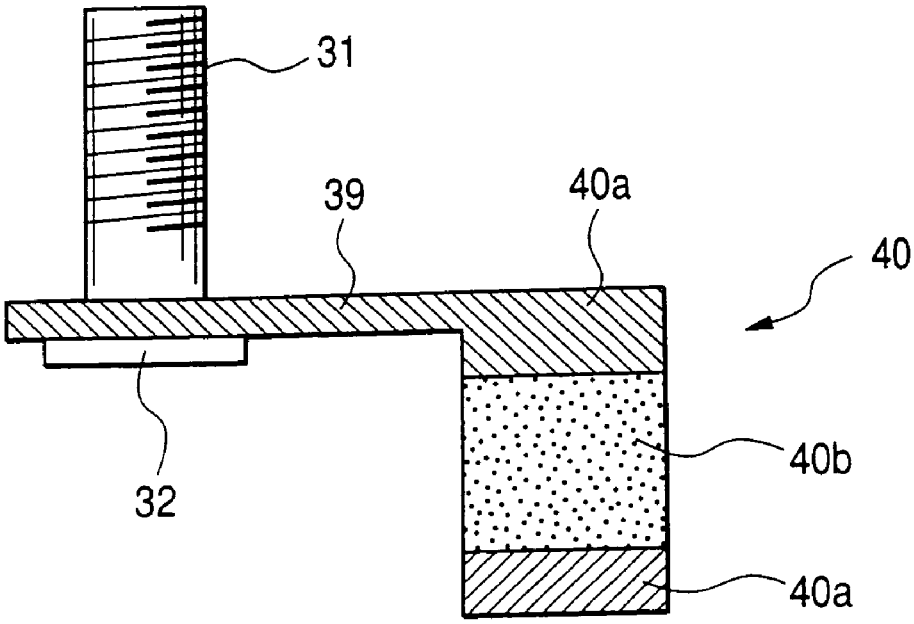
FIG. 8 is an enlarged cross-sectional view showing a second fixed contact, an electrically conductive member, and a terminal of a starter solenoid switch according to the sixth embodiment of the invention.

FIG. 8 shows a second fixed contact 40 of a starter solenoid switch according to the sixth embodiment of the present invention.

The starter solenoid switch of the present embodiment is almost identical to those of the previous embodiments.

However, in this embodiment, a low-resistance portion 40*a* is integrally formed with the conductive metal plate 39 and the external terminal 31 by molding.

In other words, the starter solenoid switch according to the present embodiment further includes the conductive metal plate 39 and the terminal 31.

Since the low-resistance portion 40*a*, the conductive metal plate 39, and the terminal 31 are made of the same material and formed integrally, the manufacturing of the starter as a whole is facilitated, thus saving the manufacturing cost.

[Variation]

While the above particular embodiments of the invention have been shown and described, it will be understood by those who practice the invention and those skilled in the art that various modifications, changes, and improvements may be made to the invention without departing from the spirit of the disclosed concept.

For example, in the previous embodiments, only the second fixed contact 40 of the second set B of contacts is made of carbon materials.

However, in addition to the second fixed contact 40, the second movable contact 41 of the second set B of contacts may also be made of carbon materials and have a structure similar to that of the second fixed contact 40.

Such modifications, changes, and improvements within the skill of the art are intended to be covered by the appended claims.

What is claimed is:

1. A starter solenoid switch comprising:

a first set of contacts including a first fixed contact and a first movable contact, said first set of contacts being disposed between a battery and a starter motor to make and break an electrical connection therebetween; and a second set of contacts including a second fixed contact and a second movable contact, said second set of contacts being disposed electrically parallel to said first set of contacts between the battery and the starter motor, said first and said second sets of contacts being so configured that the second movable contact makes contact with the second fixed contact to supply a lighter electric current to the starter motor before the first movable contact makes contact with the first fixed contact to supply a heavier electric current to the starter motor, wherein one of the second fixed contact and the second movable contact includes a low-resistance portion at one end thereof and a high-resistance portion that contains more carbon than the low-resistance portion, and wherein the low-resistance and the high-resistance portions are serially disposed along a conducting path of electric current from the battery to the starter motor.

2. The starter solenoid switch as set forth in claim 1, wherein the low-resistance portion of the one of the second fixed contact and the second movable contact has an electric resistivity of 100 $\mu\Omega$cm or less, and the high-resistance portion of the same has an electric resistivity of 100 times or more higher than that of the low-resistance portion.

3. The starter solenoid switch as set forth in claim 1, further comprising an electrically conductive member that is electrically and mechanically connected to the low-resistance portion of the one of the second fixed contact and the second movable contact.

4. The starter solenoid switch as set forth in claim 3, wherein the electrically conductive member is a twisted wire made of a metal material.

5. The starter solenoid switch as set forth in claim 3, wherein the electrically conductive member is a metal plate.

6. The starter solenoid switch as set forth in claim 1, wherein the one of the second fixed contact and the second movable contact further includes an intermediate portion that is interposed between the low-resistance portion and the high-resistance portion and has a coefficient of thermal expansion between those of the low-resistance and the high-resistance portions.

7. The starter solenoid switch as set forth in claim 1, wherein the second fixed contact includes the low-resistance portion and the high-resistance portion.

8. The starter solenoid switch as set forth in claim 7, wherein the second fixed contact is so arranged that the low-resistance portion is to be connected to an external terminal, which is connected to the battery, in a manner allowing heat transfer from the second fixed contact to the external terminal.

9. The starter solenoid switch as set forth in claim 8, further comprising an electrically conductive member, wherein the second fixed contact is so arranged that the low-resistance portion is to be connected to the external terminal via the electrically conductive member.

10. The starter solenoid switch as set forth in claim 7, further comprising a terminal and an electrically conductive member both of which are integrally formed with the low-resistance portion of the second fixed contact by molding.

11. A starter solenoid switch comprising:

a first set of contacts including a first fixed contact and a first movable contact, said first set of contacts being disposed between a battery and a starter motor to make and break an electrical connection therebetween; and a second set of contacts including a second fixed contact and a second movable contact, said second set of contacts being disposed electrically parallel to said first set of contacts between the battery and the starter motor, said first and said second sets of contacts being so configured that the second movable contact makes contact with the second fixed contact to supply a lighter electric current to the starter motor before the first movable contact makes contact with the first fixed contact to supply a heavier electric current to the starter motor, wherein one of the second fixed contact and the second movable contact includes a first low-resistance portion at a first end thereof, a second low-resistance portion at a second end thereof that is opposite to the first end, and a high-resistance portion between the first and the second low-resistance portions which contains more carbon than both the first and the second low-resistance portions, and wherein the first low-resistance portion, the high-resistance portion, and the second low-resistance portion are serially disposed along a conducting path of electric current from the battery to the starter motor.

12. The starter solenoid switch as set forth in claim 1, wherein both the first and the second low-resistance portions of the one of the second fixed contact and the second movable contact has an electric resistivity of 100 $\mu\Omega$cm or less, and the high-resistance portion of the same has an electric resistivity of 100 times or more higher than those of the first and the second low-resistance portions.

13. The starter solenoid switch as set forth in claim 1, further comprising an electrically conductive member that is electrically and mechanically connected to one of the first and the second low-resistance portions of the one of the second fixed contact and the second movable contact.

14. The starter solenoid switch as set forth in claim 13, wherein the electrically conductive member is a twisted wire made of a metal material.

15. The starter solenoid switch as set forth in claim 13, wherein the electrically conductive member is a metal plate.

16. The starter solenoid switch as set forth in claim 13, wherein the first low-resistance portion of the one of the second fixed contact and the second movable contact is electrically and mechanically connected to the electrically conductive member and the second low-resistance portion of the same faces the other one of the second fixed contact and the second movable contact.

17. The starter solenoid switch as set forth in claim 11, wherein the one of the second fixed contact and the second movable contact further includes a first and a second intermediate portion that are interposed between the first low-resistance portion and the high-resistance portion and between the second low-resistance portion and the high-resistance portion, respectively, and have a coefficient of thermal expansion between those of the first and the second low-resistance portions and the high-resistance portion.

18. The starter solenoid switch as set forth in claim 11, wherein the second fixed contact includes the first low-resistance portion, the high-resistance portion, and the second low-resistance portion.

19. The starter solenoid switch as set forth in claim 18, wherein the second fixed contact is so arranged that one of the first and the second low-resistance portions is to be connected to an external terminal, which is connected to the battery, in a manner allowing heat transfer from the second fixed contact to the external terminal.

20. The starter solenoid switch as set forth in claim 19, further comprising an electrically conductive member, wherein the second fixed contact is so arranged that one of the first and the second low-resistance portions is to be connected to the external terminal via the electrically conductive member.

21. The starter solenoid switch as set forth in claim 18, further comprising a terminal and an electrically conductive member both of which are integrally formed with one of the first and the second low-resistance portions of the second fixed contact by molding.

* * * * *